US005293699A

United States Patent [19]

Faust et al.

[11] Patent Number: 5,293,699

[45] Date of Patent: Mar. 15, 1994

[54] PROCESS AND APPARATUS FOR GUIDING A COATED MATERIAL STRIP

[75] Inventors: Horst Faust, Geisenheim-Johannisberg; Joachim Stroszynski, Wiesbaden, both of Fed. Rep. of Germany

[73] Assignee: Hoechst Aktiengesellschaft, Frankfurt am Main, Fed. Rep. of Germany

[21] Appl. No.: 926,400

[22] Filed: Aug. 10, 1992

[30] Foreign Application Priority Data

Aug. 21, 1991 [DE] Fed. Rep. of Germany ..... 4127602

[51] Int. Cl.[5] ..... F26B 13/00

[52] U.S. Cl. ..... 34/156; 34/160; 226/97

[58] Field of Search ..... 34/156, 155, 160, 151, 34/152, 10, 23; 226/97

[56] References Cited

U.S. PATENT DOCUMENTS

| | | | |
|---|---|---|---|
| 2,691,225 | 10/1954 | Kamprath | 34/156 |
| 3,061,940 | 11/1962 | Cichelli | 34/156 |
| 3,807,056 | 4/1974 | Norfolk | 34/156 |
| 4,271,601 | 6/1981 | Koponen et al. | 34/156 |
| 4,274,210 | 6/1981 | Stengard | 34/156 |
| 4,768,695 | 9/1988 | Stibbe | 34/156 |
| 4,833,794 | 5/1989 | Stibbe et al. | 34/156 |
| 4,901,449 | 2/1990 | Wimberger | 34/156 |
| 5,147,690 | 9/1992 | Faust et al. | 34/156 |

FOREIGN PATENT DOCUMENTS

| | | |
|---|---|---|
| 0414125A3 | 8/1989 | European Pat. Off. . |
| 970045 | 8/1958 | Fed. Rep. of Germany . |
| 1143474 | 8/1960 | Fed. Rep. of Germany . |
| 459070 | 12/1965 | Fed. Rep. of Germany . |
| 90/03099 | 3/1990 | PCT Int'l Appl. . |
| 847548 | 9/1960 | United Kingdom . |
| 82/03450 | 10/1982 | World Int. Prop. O. . |

OTHER PUBLICATIONS

Kramer et al., "Heavy Duty Levitation Dryer in a Modern Strip-coating Line," Journal Gas Wäme International, vol. 24, No. 12, pp. 527-531 (1975).

*Primary Examiner*—Henry A. Bennet
*Assistant Examiner*—Denise Gromada
*Attorney, Agent, or Firm*—Foley & Lardner

[57] ABSTRACT

An apparatus for guiding a coated material strip through a dryer has a plurality of guide elements disposed in the dryer so that the plurality of guide elements are equally-spaced. The plurality of guide elements each have a gas-permeable guide face which faces an underside of the coated material strip. A device for supplying a gas to the plurality of guide elements is provided so that a gas stream passes through each of the gas-permeable guide faces and supports the coated material.

15 Claims, 3 Drawing Sheets

PROCESS AND APPARATUS FOR GUIDING A COATED MATERIAL STRIP

BACKGROUND OF THE INVENTION

1. Field of the Invention

The invention relates to a process and an apparatus for guiding a coated material s trip in an initial drying zone, without requiring mechanical contact, by utilizing a heated gas.

2. Description of the Related Art

It is currently the state of the art to perform a surface treatment in floating film dryers for film or metal strips utilizing the aid of a supporting-air nozzle system which permits the material to be guided in the dryer without requiring mechanical contact. (journal "gas warm international", Volume 24 (1975), No. 12, pp. 527–531). In such dryers, the dryer air which is enriched with solvent is extracted directly in the nozzle zones in order to eliminate an undesired transversal flow. This produces so-called nozzle dryers or impact-jet dryers, in which a particular disadvantage is the impact of the point-like flow of individual nozzles, which tends, both in the case of laminar flow form and in the case of turbulent flow form, to cause flow-physical instabilities. The flow-physical instabilities, particularly in the case of low-viscosity liquid films, inevitably results in irreversible drying structures.

To avoid impact point-like flows in the beginning of the dryer apparatus, PCT Application WO 82/03450 discloses that the dryer air is directed out of an antespace, via suitable inlet openings and flow deflectors, and into a stabilized intermediate space. From the intermediate space, part of the dryer air passes via a porous filter element, arranged in the direct vicinity of the liquid jet, to the web to be dried. The operating principle of such drying is based on the fact that between the porous protective shield and the liquid film to be dried, there is formed a stabilized, yet highly solvent-enriched, weak air flow, which is constantly renewed by exchange with the residual air flowing transversely over the porous medium. Consequently, by virtue of the relatively short overall dryer length, a predrying of the liquid film with a reduced tendency for exhibiting mottling effects is accomplished.

This type of drying is predominantly characterized by the diffusion of the solvent vapor/air mixture through the porous protective shield. A complete drying out of the liquid film is only possible by having very great dryer lengths or by utilizing auxiliary dryers further downstream, because of the virtually complete lack of convective removal within the space that exists between strip and protective shield.

In the drying of products in web forms which have large surface areas on which liquid layers are applied, different drying processes and drying apparatuses have been used. Typical drying products are, for example, metal or plastic strips on which liquid layers are applied. As a rule, these liquid layers are composed of vaporizable components, which are removed from the liquid film during the drying process, and of non-vaporizable components, which remain on the base material after drying. In general, the webs which are to be dried are initially passed through an initial drying zone and subsequently through an actual drying zone. The coating gives the surfaces of the base materials special properties, which are not present in the form in which they are desired for later use until after the drying process.

AS an example of this, mention can be made of the coating of metal strips, in particular aluminum strips, with light-sensitive layers, which are made into printing plates. The coating of metal strips or plastic sheets with a solvent-containing wet film, referred to hereinafter as a liquid film, and its subsequent drying, constitute an operation which requires special installations in order to ensure the desired product quality of the layers. What is essential in this case are the process steps of the initial drying and the final film drying as the final process measures of the coating.

The uniform drying of the blasting-sensitive coatings on the base material in dryers in which a dryer air flow runs parallel to the coated strip, is primarily disturbed by mechanical guide elements, such as rolls, for the base material and the coated metal strip. Very good drying results, with regard to the layer cosmetics, are obtained utilizing corresponding air conduction on the layer side that is to be dried if the material strip is guided in close proximity to the bottom of the dryer. If the material strip is passed, for example, over a level dryer bottom, which is composed for example of aluminum, there is the risk that so-called longitudinal scratches will occur on the underside of the material strip which can damage the coated material strip or even render it unusable.

If the bottom of the dryer is lined with a soft material,, such as for example a woven fabric, felt or a nonwoven fabric, the aforementioned longitudinal scratches are avoided. However, due to the different widths of the material strips, these lining materials are cut into. When the lining materials are cut into, particles of the lining material are formed which become deposited on the layer to be dried. Consequently, the layer to be dried becomes soiled and the lining materials become scored, which prevents a uniform contact with the guiding surface.

If the bottom of the dryer is lined with a material which has a substantially lower friction value than the material strip and which is temperature-resistant, such as for example polytetrafluoroethylene, this material will not remain mechanically resistant with respect to the edges of the material strip over an extended period.

SUMMARY OF THE INVENTION

An object of the invention is to provide a process and an apparatus so that a coated material strip can be contactlessly guided in an initial drying zone in such a way that the uniform initial drying of the liquid layer on the material strip is not impaired, and the effects of wear do not occur on the guiding means.

This object is achieved by a process which includes directing a gas stream to flow against a material strip in a direction which is perpendicular to a longitudinal and a running direction of the material strip, multiply interrupting the flow of the gas stream beneath the material strip so that it flows in the longitudinal direction of the material strip, creating a gas film due to the flow of the gas stream, and supporting the material strip by the gas film.

In a refinement of the process, first and second parts of the gas stream flow off in the running direction of the material and a direction opposite thereto, respectively. In addition, the material strip is guided over permeable guide elements, the gas stream is passed through the permeable guide elements, and the permeability of the guide elements is used to increase a pressure of the gas stream before the gas stream exits from the guide elements. Moreover, air is provided as the gas stream the air is at a temperature which is higher than a temperature of the drying zone.

In the inventive process, an air lubrication is accomplished between the material strip and the guide elements, with the lubrication taking place in very small spacings. The distance between the material strip and the guide elements is in this case substantially less than 1 mm, but may also be up to 1 mm. With appropriate material selection of the guide elements, which are generally air-permeable, the gas or air pressure to be preset is substantially lower than 1 bar. The relationship between the gas or air pressure to be preset for the lubrication and the gas or air permeability of the material for the guide elements is particularly important for creating a uniform and uninterrupted gas or air film between the material strip and the guide elements which are transverse to the through-running direction of the material strip. The exiting energy of the gas or the air from the guide elements must be quickly converted by the creation of microvortices into heat and pressure, which increase the effectiveness of the gas or air film. As a result, a flowing-around of the gas or air at the strip edges is avoided preventing damage to the blasting-sensitive liquid layer which can be caused by such a flow pattern.

An apparatus for guiding a coated material strip through a dryer has a plurality of guide elements disposed in the dryer so that the plurality of guide elements are equally spaced. The plurality of guide elements each have a gas-permeable guide face which faces an underside of the coated material strip. A device for supplying a gas to the plurality of guide elements is provided so that a gas stream passes through each of the gas-permeable guide faces and supports the coated material.

In a refinement of the apparatus according to the invention, each guide element includes a duct or supply tube which receives the gas, and the plurality of guide elements are all connected to the supplying device via a common supply line.

Moreover, the apparatus can also include an extraction line through which the gas stream which passes through each of the plurality of guide elements is drawn off.

In a further embodiment of the invention, an apparatus is provided wherein each of the plurality of guide elements includes a right-parallelepipedal air-permeable body which is disposed relative to its length transverse to a running direction of the material strip and a control duct. Moreover, the gas is a drying gas which flows via the control duct into the interior of the guide element along its longitudinal direction. Each of the air-permeable bodies is sintered metal or porous glass, and the three outer sides of each of the air-permeable bodies which do not face the material strip each have a barrier layer of lacquer or plastic thereon which seals the three outer sides and prevents the escape of the gas.

Since the gas or air supply which is applied underneath the material strip in accordance with the invention is not applied over its full surface area, an advantage is achieved in that a uniform sliding effect of the material strip is preserved over the entire web width, without the material strip being pushed up at the edges. In this case, interruptions of the airflow due to slight depressions in the sliding faces of the guide elements, which lie transverse to the material strip, have proven to be particularly advantageous.

BRIEF DESCRIPTION OF THE DRAWINGS

The invention is explained in more detail below with reference to graphically represented illustrative embodiments of the apparatus, in which.

DETAILED DESCRIPTION OF THE PREFERRED EMBODIMENTS

Figure 1:
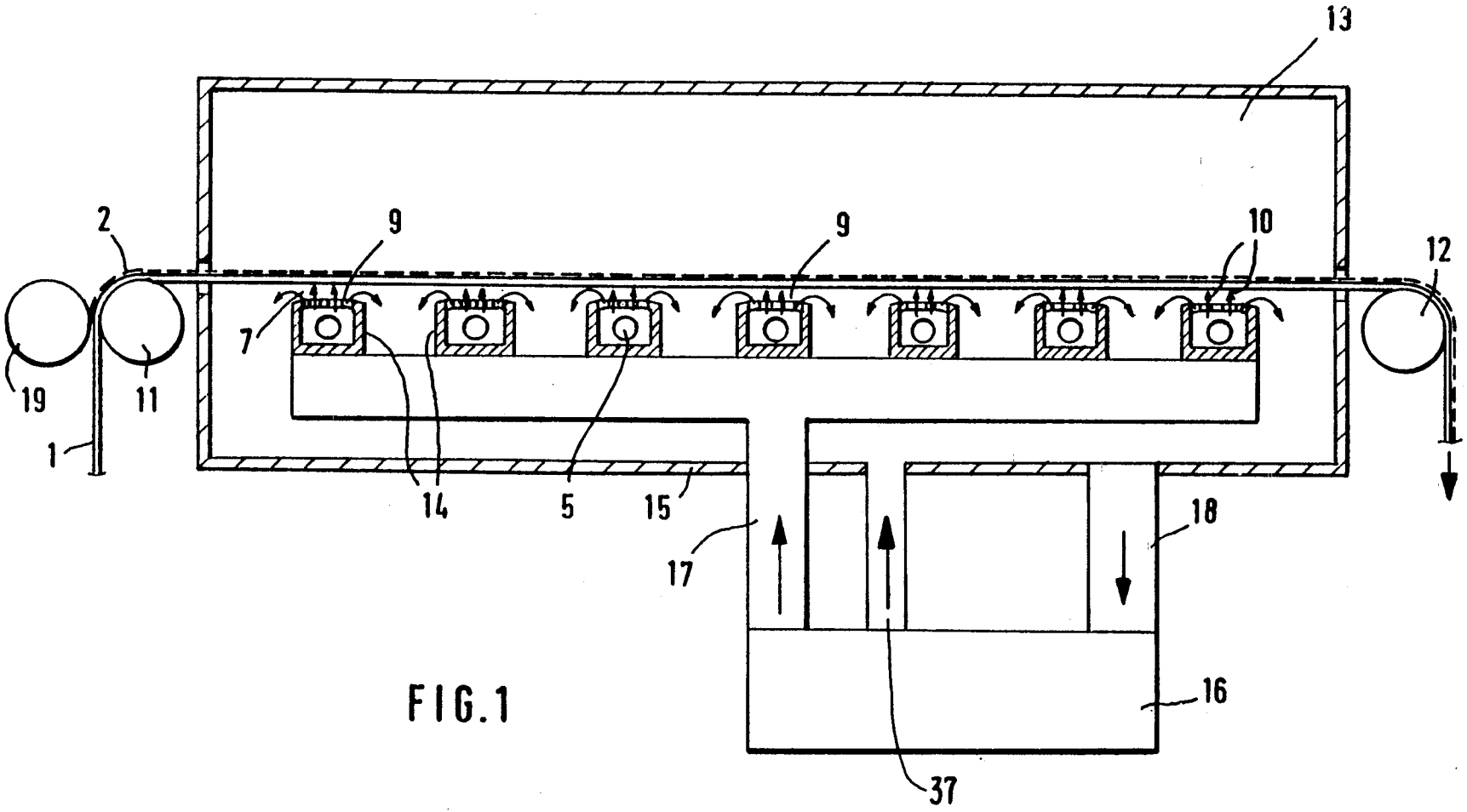
FIG. 1 is a diagrammatic sectional view through a dryer having a number of guide elements according to the invention for the material strip.

In FIG. 1, a dryer 13 having an air-lubricated guidance of a material strip 1 is shown. The material strip 1 runs from an inlet into the dryer 13 via a deflecting roll 11, opposite to which there lies an applying roll 19 for a liquid layer 2. Once the liquid layer 2 has been applied by the applying roll 19 to the material strip 1, the latter enters the dryer 13 through a gap and is horizontally led over guide elements 14. On the rear side of the dryer 13, the coated material strip 1 leaves from a gap and is led downward over a deflecting roll 12. The dryer 13 has a housing 15, through the underside of which a supply line 17 and an extraction line 18 pass. Each of the guide elements 14 is connected to supply line 17 through which gas or air is supplied. Normally, air is used as the guiding gas for the material strip 1 and the air typically has a higher temperature than the surrounding environment within the dryer 13. Each of the guide elements 14 includes a run-in duct 5 for receiving the gas or air being supplied. The supply line 17 is separate from a line 37 which supplies the drying air, and is also operated independently. A unit 16 (not shown in detail) for the air supply includes an air compressor with an upstream super-fine filter, and a downstream heat exchanger, as well as corresponding pipelines and fittings and a corresponding control system. The guide faces 9 of the guide elements 14 which face the material strip 1 are permeable to gas or air, so that the air flows in a perpendicular direction onto the material strip 1. Thus, an air film 7 is formed so that the coated material strip 1 with the blasting-sensitive liquid layer 2 slides without having any mechanical contact with the guide faces 9 of the guide elements 14.

The air pressure or gas pressure, prior to the exiting of the air or the gas from the guide elements 14, may increase up to 1 bar or more depending substantially on the permeability of the guide faces 9. The more permeable that these guide faces 9 are, the less the pressure increases within the guide elements 14 prior to the exiting of the air or the gas. The distance between the underside of the material strip 1 and the guide faces 9 is less than I mm, but may also be up to 1 mm in size. The air film 7 flows off in both the running direction of the material strip 1 and in a direction opposite thereto. The spaces which exist between any two adjacent guide elements, functions as a flowing-offregion for the air film 7. Since the amount of air flowing off is very small, the overall guiding and flowing behavior within the dryer 13 is not influenced, so that no disturbance of the layer cosmetics occurs during the initial drying of the liquid layer 2 on the material strip 1.

Through the run-in ducts 5, the air flows into the air-permeable bodies of the guide elements 14 and subsequently flows upward through the guide face 9 as guide air 10 against the material strip. To prevent the guide air 10 from flowing off laterally and downwardly through the outer walls of the guide elements, these outer walls are sealed off, as is further described in more detail below.

Figure 2:
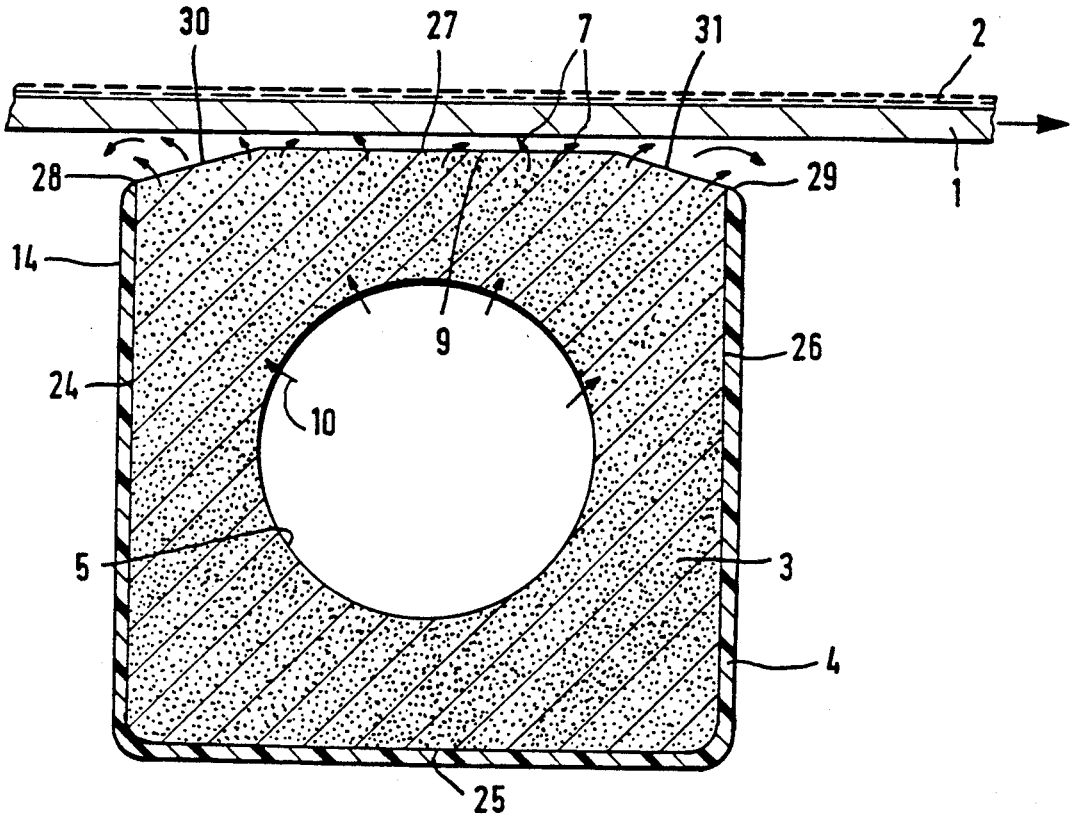
FIG. 2 is a sectional view of a first embodiment of a guide element according to the invention.
Figure 3:
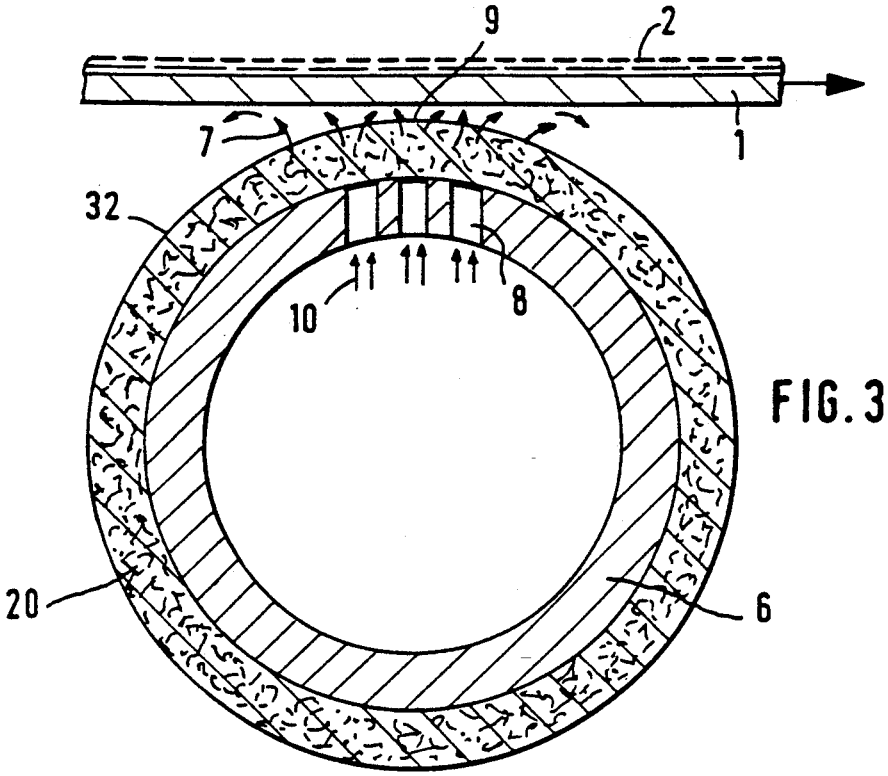
FIG. 3 is a sectional view of a second embodiment of a guide element according to the invention.
Figure 4:
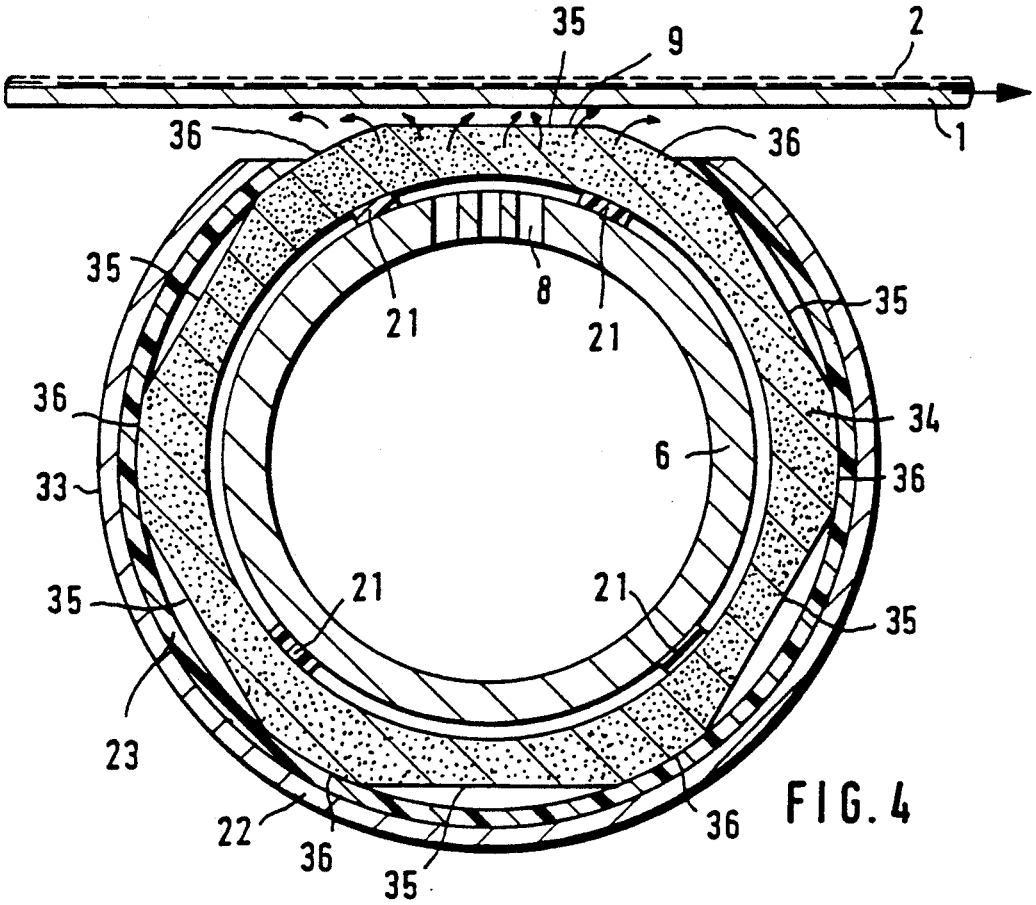
FIG. 4 is a sectional view of a third embodiment of a guide element according to the invention.

In FIGS. 2 to 4, different embodiments of guide elements 14, 32, 33 are represented, which in each case can be used in the dryer 13 of FIG. 1. FIG. 2 shows an individual guide element 14 of the dryer 13 in detail. The guide element 14 includes a right-parallelepipedal air-permeable body 3, which is supplied from the inside with superfine-filtered air via a central run-in duct. The air-permeable body 3, which is arranged in terms of its length transversely to the running direction of the material strip 1, is composed of sintered metal or porous glass. Three outer sides 24, 25, 26 of the body 3, which are not facing the material strip 1, are sealed off on the outside by a barrier layer 4 of lacquer or plastic to protect against the undesired escape of air from the body 3. The fourth outer side 27, which lies opposite the underside of the material strip 1 at a distance of less than or equal to 1 mm, and in particular at a distance which is considerably less than 1 mm, has outwardly lowered, sloping surfaces 30, 31, which respectively form with the underside of the material strip 1 flowing-off zones for the flowing off of the air. The guide air is conducted centrally through the run-in duct 5, along the guide face 9, and against the material strip 1. The air then flows offboth in and against the strip-running direction and into the neighboring flowing-offzones, thereby forming the air film 7. The surface of the guide face 9 is relatively rough.

FIG. 3 shows a second embodiment of a guide element 32, which includes a manifold 6 having passage openings 8 in the region of the guide face 9 and a jacket 20, which encloses the manifold 6. The jacket 20 is permeable to air and gas and is composed of a polytetrafluoroethylene-coated nonwoven fabric or felt. The guide air 10, which flows in through the manifold 6, exits through the passage openings 8, and flows through the jacket 20, and thereby forms between the circumferential face of the jacket 20 and the underside of the material strip 1 and air film 7. The air film 7 serves as a type oflubricating film and transports the material strip 1 by allowing it to slide over the guide elements 32. The guide air 10 primarily exits from the jacket 20 underneath the material strip 1 in the region of the guide face 9. Other materials which can be used for jacket 20 include polytetrafluoroethylene-coated woven fabric, glass or carbon fibers.

In FIG. 4, a third embodiment of the guide element 33 is shown, which includes a manifold 6 having passage openings 8 for the air, a jacket 34 of sintered metal or porous glass, sliding seals 21, and a protective jacket 22. The air-permeable jacket 34 is held at a distance from the manifold 6 by the sliding seals 21 which are attached to the manifold 6. The protective jacket 22 encloses the jacket 34, with the exception of a level polygonal face 35, which faces the underside of the material strip 1. On the inner side of the protective jacket 22 there is a continuous sliding seal 23 which, like the sliding seals 21, is composed, for example, of polytetrafluoroethylene. The sliding seals 21 and 23 may be adhesively attached, for example, to the manifold 6 or to the inner slide of the protective jacket 22. The air-permeable jacket 34 is rotatable with respect to the supply tube 6, so that the overall circumferential face of the air-permeable jacket 34 can be used. That is, when the inner or outer surface which faces the material strip 1 becomes soiled, the jacket 34 can be turned so that another polygonal face 35 faces the material strip 1.

The outer side of the jacket 34 comprises level polygonal faces 35, which are joined to one another by rounded-off transitional faces 36. These transitional faces 36 facilitate the turning of the jacket 34 with respect to the fixed protective jacket 22, since they are in contact with the sliding seal 23 over only a small surface and not over the entire face of the sliding seal.

The passage openings 8 of the fixed manifold 6 face the material strip 1, and two sliding seals 21 are in the direct proximity of the passage openings 8. The other two sliding seals 21 are attached to the manifold 6 at points diametrically opposite thereto.

It is thus apparent that by utilizing the guide elements 14, 32 or 33, the material strip 1 is guided in the dryer 13 without requiring the use of mechanical moving parts, such as rolls, and the blasting-sensitive liquid layer 2 is dried in a largely trouble free manner.

While several embodiments of the invention have been described, it will be understood that further modifications are still capable, and this application is intended to cover any variations, use or adaptation of the invention and including such departures from the present disclosure as to come within the knowledge of customary practice in the art to which the invention pertains, and as may be applied to the essential features hereinbefore set forth and following within the scope of the invention and the limits of the appended claims.

What is claimed is:

1. An apparatus for guiding a coated material strip through a dryer, said apparatus comprising:

a plurality of guide elements being disposed in the dryer so that the plurality of guide elements are equally spaced from each other, said plurality of guide elements each having a gas-permeable guide face which faces an underside of said coated material strip; and means for supplying a gas to said plurality of guide elements so that a gas stream passes through each of said gas-permeable guide faces and supports said coated material;

a drying gas line through which a drying gas is supplied to said dryer, and wherein said common supply line is different from and is not associated with said drying gas line; and a common supply line;

wherein each of said plurality of guide elements includes a duct or a supply tube which receives said gas, and said plurality of guide elements are all connected to said supplying means via said common supply line.

2. An apparatus as claimed in claim 1, further comprising an extraction line through which said gas stream passing through each of said plurality of guide elements is drawn off.

3. An apparatus as claimed in claim 1, wherein each of said plurality of guide elements includes a right-parallelepipedal air-permeable body which is disposed relative to its length transverse to a running direction of the material strip, and a control duct, and wherein said gas is a drying gas which flows via said control duct into the interior of the guide element along its longitudinal direction.

4. An apparatus as claimed in claim 3, wherein each of said air-permeable bodies is sintered metal or porous glass, and three outer sides of each of said air-permeable bodies which do not face said material strip each have a barrier layer of lacquer or plastic thereon which seals said three outer sides and prevents the escape of said gas.

5. An apparatus as claimed in claim 3, wherein an outer side of each of said air-permeable bodies which faces said material strip is bevelled off toward the outside of a respective one of said plurality of guide elements in the running direction of said material strip, and said outer side of each of said air-permeable bodies which faces said material strip includes sloping surfaces which slope outwardly and downwardly, said sloping surfaces forming flow-offzones with the underside of said material strip through which said gas stream flows off.

6. An apparatus as claimed in claim 3, wherein each of said plurality of guide elements includes a manifold having passage openings through which said gas stream passes and a gas permeable jacket which encloses said manifold.

7. An apparatus as claimed in claim 6, wherein said gas-permeable jacket is made from one of a polytetrafluoroethylene-coated nonwoven fabric, a felt, a woven fabric, a glass, and carbon fibers.

8. An apparatus as claimed in claim 6, wherein said passage openings face said material strip.

9. An apparatus for guiding a coated material strip through a dryer's aid apparatus comprising:

a plurality of guide elements being disposed in the dryer so that the plurality of guide elements are equally spaced from each other, said plurality of guide elements each having a gas-permeable guide face which faces an underside of said coated material strip; and means for supplying a gas to said plurality of guide elements so that a gas stream passes through each of said gas-permeable guide faces and supports said coated material;

wherein each of said plurality of guide elements includes a manifold having passage openings therein through which said gas passes, a jacket of sintered glass which has a level polygonal face which faces the underside of said material strip, first sliding seals attached to said manifold which holds said jacket at a distance from said manifold, and a protective jacket which encloses said jacket except for said polygonal face.

10. An apparatus as claimed in claim 9, wherein said protective jacket has an inner side and said jacket is rotatable, and further comprising a second sliding seal being disposed at said inner side of said protective jacket and being fixed relative to said jacket.

11. An apparatus as claimed in claim 10, wherein said first and second sliding seals are made from polytetrafluoroethylene.

12. An apparatus as claimed in claim 9, wherein said first sliding seals are made from polytetrafluoroethylene.

13. An apparatus as claimed in claim 9, wherein an outside surface of said jacket includes a plurality of level polygonal faces, said plurality of level polygonal faces being joined by corresponding rounded-off transitional faces.

14. An apparatus as claimed in claim 9, wherein said passage openings face said material strip and two of said sliding seals are attached to said manifold diametrically opposite to said passage openings.

15. An apparatus for guiding a coated material strip through a dryer, said apparatus comprising:

a plurality of guide elements being disposed in the dryer so that the plurality of guide elements are equally spaced from each other, said plurality of guide elements each having a gas-permeable guide face which faces an underside of said coated material strip; and means for supplying a gas to said plurality of guide elements so that a gas stream passes through which said gas passes, a jacket of porous glass which has a level polygonal face which faces the underside of said material strip, first sliding seals attached to said manifold which holds said jacket at a distance from said manifold, and a protective jacket which encloses said jacket except for said polygonal face.

* * * * *

UNITED STATES PATENT AND TRADEMARK OFFICE

CERTIFICATE OF CORRECTION

PATENT NO. : 5,293,699
DATED : March 15, 1994
INVENTOR(S) : FAUST et al.

It is certified that error appears in the above-indentified patent and that said Letters Patent is hereby corrected as shown below:

Claim 5, column 7, line 16, "flow-offzones" should be deleted and --flow-off zones-- should be inserted;

Claim 9, column 7, line 31, "dryer's aid" should be deleted and --dryer, said-- should be inserted;

Claim 15, column 8, line 36, after "through" the following phrase should be inserted --each of said gas-permeable guide faces and supports said coated material;

wherein each of said plurality of guide elements includes a manifold having a passage therein through--.

Signed and Sealed this

Thirteenth Day of December, 1994

Bruce Lehman

*Attest:*

BRUCE LEHMAN

*Attesting Officer*

*Commissioner of Patents and Trademarks*